US007434627B2

(12) United States Patent
Turley et al.

(10) Patent No.: US 7,434,627 B2
(45) Date of Patent: Oct. 14, 2008

(54) METHOD AND APPARATUS FOR FRICTION REDUCTION IN A DOWNHOLE TOOL

(75) Inventors: Rocky A. Turley, Houston, TX (US); John W. McKeachnie, Vernal, UT (US)

(73) Assignee: Weatherford/Lamb, Inc., Houston, TX (US)

( * ) Notice: Subject to any disclaimer, the term of this patent is extended or adjusted under 35 U.S.C. 154(b) by 226 days.

(21) Appl. No.: 11/152,409

(22) Filed: Jun. 14, 2005

(65) Prior Publication Data

US 2006/0278405 A1 Dec. 14, 2006

(51) Int. Cl.
*E21B 23/00* (2006.01)
*E21B 33/128* (2006.01)

(52) U.S. Cl. ..... 166/385; 166/387; 166/138; 166/216; 166/242.1; 277/339

(58) Field of Classification Search ..... 166/385, 166/387, 179, 118, 216, 217, 241.1, 241.5, 166/241.6, 138, 50, 101, 153; 277/323, 334, 277/339, 340
See application file for complete search history.

(56) References Cited

U.S. PATENT DOCUMENTS

| | | | | | |
|---|---|---|---|---|---|
| 1,436,274 | A * | 11/1922 | Mack | ..... | 166/137 |
| 1,690,721 | A * | 11/1928 | Dillon | ..... | 166/209 |
| 1,809,080 | A * | 6/1931 | Sweet et al. | ..... | 166/123 |
| 1,949,498 | A * | 3/1934 | Stone et al. | ..... | 166/113 |
| 2,569,457 | A * | 10/1951 | Dale et al. | ..... | 166/123 |
| 3,403,731 | A * | 10/1968 | Arutunoff | ..... | 166/211 |
| 3,667,543 | A | 6/1972 | Dean | | |
| 3,905,227 | A * | 9/1975 | Kinley | ..... | 73/152.57 |
| 4,424,861 | A * | 1/1984 | Carter et al. | ..... | 277/334 |
| 4,941,511 | A * | 7/1990 | Johansen et al. | ..... | 138/89 |
| 5,947,213 | A * | 9/1999 | Angle et al. | ..... | 175/24 |
| 6,478,086 | B1 * | 11/2002 | Hansen | ..... | 166/250.17 |
| 6,712,153 | B2 | 3/2004 | Turley et al. | | |

FOREIGN PATENT DOCUMENTS

| | | |
|---|---|---|
| SU | 1263809 | 10/1986 |
| SU | 1543046 | 1/1990 |
| WO | WO 03/067016 | 8/2003 |

OTHER PUBLICATIONS

UK Examination and Search Report, Application No. 0611751.9, dated Oct. 10, 2006.

* cited by examiner

*Primary Examiner*—Kenneth Thompson
(74) *Attorney, Agent, or Firm*—Patterson & Sheridan, L.L.P.

(57) ABSTRACT

A system for facilitating the insertion of a tool into a wellbore, especially a non-vertical wellbore. In one embodiment a tool is fixable in a wellbore and includes centralizing, friction-reducing members that serve to keep the body of the tool off the walls of the wellbore. In another embodiment the tool includes a wiper ring that partially fills an annular area formed between the centered tool and the wellbore walls. The surface of the ring facing the upper end of the wellbore provides fluid resisting piston surface and permits the centered tool to be pumped down the wellbore more effectively.

29 Claims, 4 Drawing Sheets

METHOD AND APPARATUS FOR FRICTION REDUCTION IN A DOWNHOLE TOOL

FIELD OF THE INVENTION

The present invention relates to downhole tools. More specifically, the invention relates to tools run into a wellbore and apparatus and methods to facilitate their insertion. More particularly still, the invention relates to a centering device having friction reducing members to reduce contact of a tool with the walls of a non-vertical wellbore. The invention also facilitates "pumping" a tool into a wellbore with fluid when gravity is not available.

BACKGROUND OF THE INVENTION

Various operations require tools to be inserted into a well and fixed there temporarily. In some instances, packers are run into a wellbore and then set using slips and cones that fix the packer at a predetermined location to isolate an annular area of the bore. In other instances, bridge plugs or "frac" plugs are similarly installed to temporarily block the wellbore and provide a barrier against which pressure can be developed to treat a hydrocarbon-bearing formation adjacent the wellbore. In all of these instances, the tool is typically disconnected from a run-in string of tubulars and left in place during the operation. Thereafter, some of the tools can be retrieved to the surface while others must be destroyed with a milling device.

Increasingly, hydrocarbons are collected from wellbores that are not vertical but extend outward, sometimes horizontally from a central wellbore. These non-vertical wellbores are cased and completed just like their vertical counterparts and are also subject to the same treatments and tools. Tools can always be run into a non-vertical wellbore on rigid tubing but that requires a rig and complimentary equipment to connect the tubing as it is inserted and removed from the wellbore. Coil tubing is thin-walled, removable, continuous tubing without joints. Coil tubing is available for running tools into a well but must be transferred to the well site on large reels and then requires some type of injector to be installed in the wellbore.

Because of the above disadvantages of tubing, the preferred way to install many downhole tools is with wireline. Wireline is a cable comprising one or more conductors which provides real-time communication with a downhole tool and can also bear the weight of the tool. Wireline is designed to be reeled into a wellbore with the tool on one end. In operations requiring many tools to be placed in the wellbore, like fracturing operations including multiple zones, wireline installation saves time and money.

Problems with wireline installations arise with non-vertical wellbores simply because gravity is not available to help urge the tool down the wellbore. Rather than move along the center of the wellbore, the tools tend to rest on the low side of the bore, coming into contact with any debris that has settled there.

Various means have been used to overcome the problem of wireline delivered tools and non-vertical wellbores. In some instances the tools are "pumped down" with fluid pumped past the tool. This is partially effective but due to the position of the tool on the low side of the wellbore, a large annular gap extends between the top of the tool and the upper wall of the wellbore, making the pumping process partially ineffective. In other instances, tractors are used to help move a tool along a non-vertical portion of a wellbore. Tractors typically have at least one moving member that either rotates or oscillates against a wellbore wall. However, tractors are expensive, cannot be left in a well and add another layer of complication to a tool installation job.

There is a need therefore for a method and apparatus that can facilitate the installation of a tool into a wellbore, particularly a non-vertical portion of a wellbore. There is a further need for a tool that has a friction-reducing component to reduce the friction that necessarily arises as the tool moves along a non-vertical wellbore. There is a further need for a tool that has centering capabilities to reduce its tendency to sit on a low side of a non-vertical wellbore. There is yet a further need for a tool that can better utilize an annular area created between the tool and the wellbore to facilitate pumping down the tool with circulating fluids.

SUMMARY OF THE INVENTION

The invention relates to a system for facilitating the insertion of a tool into a wellbore, especially a non-vertical wellbore. In one embodiment a tool is fixable in a wellbore and includes centralizing, friction-reducing members that serve to keep the body of the tool off the walls of the wellbore wall. In another embodiment the tool includes a wiper ring that partially fills an annular area formed between the centered tool and the wellbore walls. The surface of the ring facing the upper end of the wellbore provides fluid resisting piston surface and permits the centered tool to be pumped down the wellbore more effectively.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
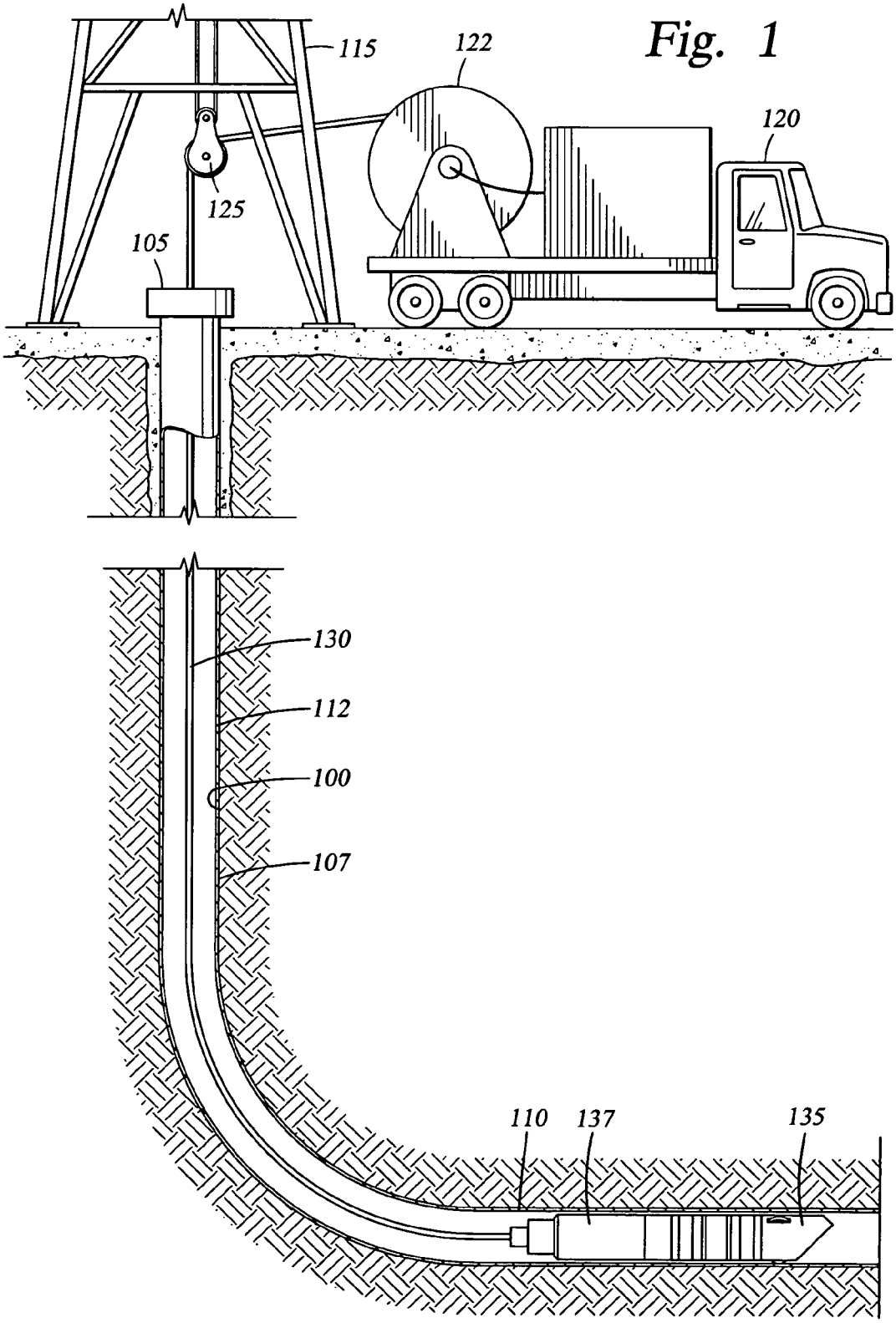
FIG. 1 is a view, partially in section of a wellbore, showing a tool being run in on wireline.

FIG. 1 shows a typical completed well with a wellbore 100, a wellhead 105, a vertical wellbore section 107 and a non-vertical wellbore section 110. The wellbore is lined with casing 112. Installed over the well is a rig 115 placed there to facilitate the insertion of a tool or tools into the wellbore. A truck 120 is shown with a reel 122 of wireline that can be directly placed in the wellbore via a block and tackle assembly 125 of the rig.

At a lower end of the wireline 130, in the non-vertical section 110 of the wellbore is a tool 135. Like those described herein, the tool is designed to be located via the wireline at a predetermined location in the wellbore and then fixed to the wall of the wellbore by remotely actuating a slip and cone assembly (not shown) built onto the tool. In one instance, the downhole tool is a plug with a central bore that can be temporarily blocked in a single direction during an operation. In a wireline installation, the plug is typically actuated or set using a setting tool 137 schematically shown at an upper end of the tool. The setting tool includes a charge or some chemical compound that creates a force used to cause one part of the tool to move in relation to another part, thereby setting the slip. The action is initiated from the surface of the well by a signal that travels down a conductor in the wireline 130. Setting tools are readily available and one setting tool is a Baker E-4 wireline setting assembly sold by the Baker-Hughes Company of Houston, Tex.

Figure 2:
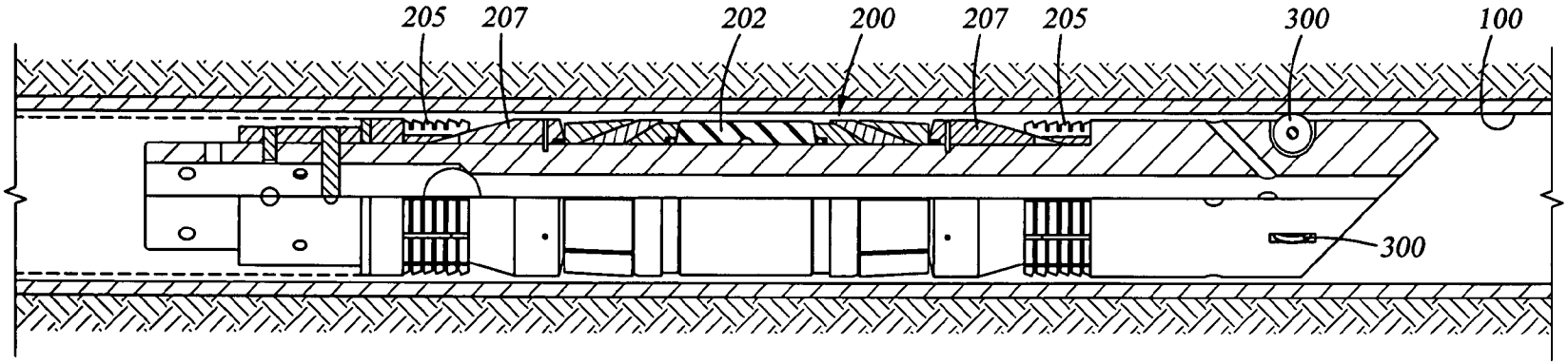
FIG. 2 is a section view of a tool including the centralizing, friction reducing members of the present invention.
Figure 3:
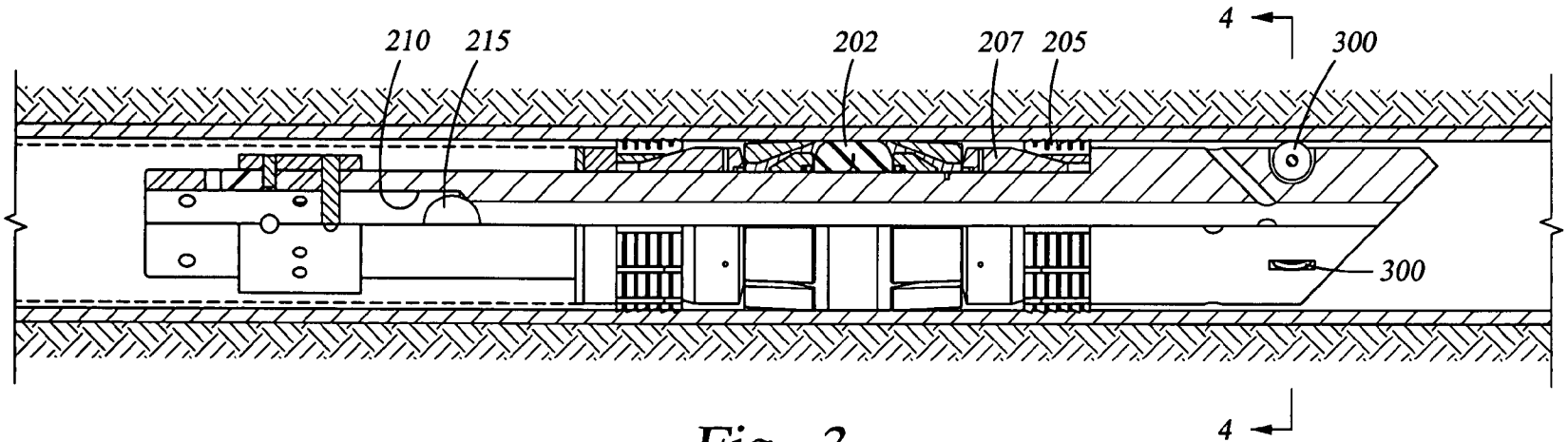
FIG. 3 is a section view of the tool of FIG. 2 after it has been set in the wellbore.

FIG. 2 is a section view of a tool 200 shown in a wellbore 100 prior to being set. For illustrative purposes, the setting tool and wireline string is not shown. The tool includes a first portion and a second portion that are designed to move axially relative to each other in order to compress portions of the tool and set the tool in the wellbore (FIG. 3). The main components of the tool are well known. For instance, there is a deformable sealing member 202 and a set of slips 205 that move across conical surfaces 207 to increase an outer diameter of the tool 200 and place the slips 205, with their toothed outer surfaces, into contact with the walls of the cased wellbore 100.

FIG. 3 shows the tool set in the wellbore. Relative movement between the first portion of the tool and the second portion has caused the sealing member 202 and slips 205 to contact the wellbore 100 and fix the tool 200 in the wellbore. Visible in both FIGS. 2 and 3 is a bore 210 of the tool and a ball 215 that is seated in the bore to block the flow of fluid through the bore in at least one direction. Typically, the bore 210 is temporarily blocked to permit pressure to be developed above the tool in order to carry out an operation, like fracing the well. After the operation is complete, some tools are designed to be removed from the wellbore and reused. Others however, are designed to be milled and destroyed and are thus irretrievable. In one instance, the tools are constructed largely of a non-metallic material that can withstand certain extremes of temperatures and pH conditions and can be more easily drilled when the tool's use is completed. An example of such a non-metallic tool is disclosed and claimed in U.S. Pat. No. 6,712,153, assigned to Weatherford/Lamb, Inc. of Houston, Tex., and that patent is incorporated herein by reference in its entirety.

Figure 4:
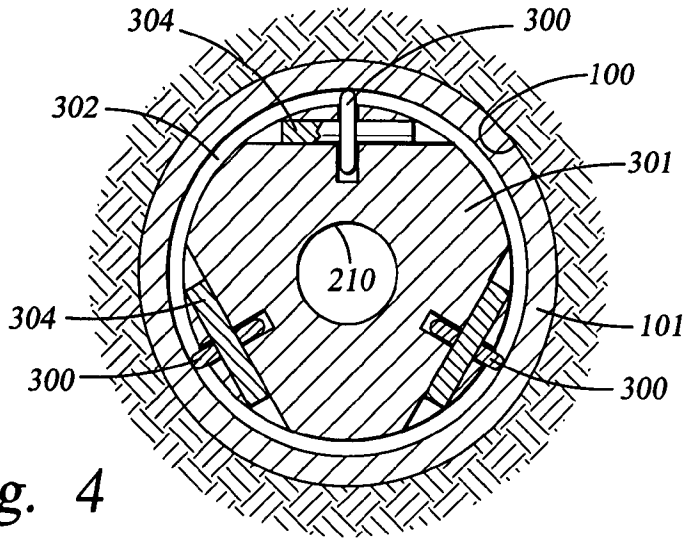
FIG. 4 is a section view of the tool along a line 4-4 of FIG. 3.

FIGS. 2-7 all illustrate various aspects of the invention designed to facilitate the insertion of a tool 200 like the one shown, into a wellbore, especially a non-vertical wellbore. In the embodiment shown in FIGS. 2-4, the tool is provided with a friction reducing system including friction reducing members in the form of rollers 300 that are outwardly extended and radially disposed around a front end of the tool 200. The relationship of the rollers 300 to the body of the tool 200 and to the wellbore 100 therearound is illustrated in FIG. 4. Visible is the body 301 of the tool, bore 210 of the tool and the rollers 300 that are mounted on axles 304 and operate to center the tool in the wellbore, provide a uniform annular space around the tool and prevent substantial contact between the body of the tool and the wellbore 100. In FIG. 4, the rollers 300 contact the wellbore casing 101, leaving an annular space 302 between the body of the tool 200 and the casing wall.

The advantage of this arrangement when a tool is run into a non-vertical wellbore on wireline is obvious. Rather than lay on the lowest side of the wellbore 100, the tool 200 is held off the sides of the wellbore and only the rollers 300 with their friction reducing qualities are exposed to the wall. Additionally, because of the stand-off, the tool is less likely to be slowed by sediment and other debris that settles on the low side of the wellbore 100. Finally, the uniform annular space 302 around the tool 200 improves its "pump down" characteristics. The position of the rollers 300 towards the leading end or front of the tool 200 increases their effectiveness. Rather than being installed on some other component, like the setting tool, the rollers are as close as possible to the leading edge of the tool that will be fixed in the wellbore. The rollers are also installed in a manner that ensures the outer diameter of the tool 200 will "draft" through the wellbore 100. Alternatively, the rollers could be spring-mounted to permit some compliance but in all cases they are designed to maintain the tool coaxially in the wellbore.

Figure 6:
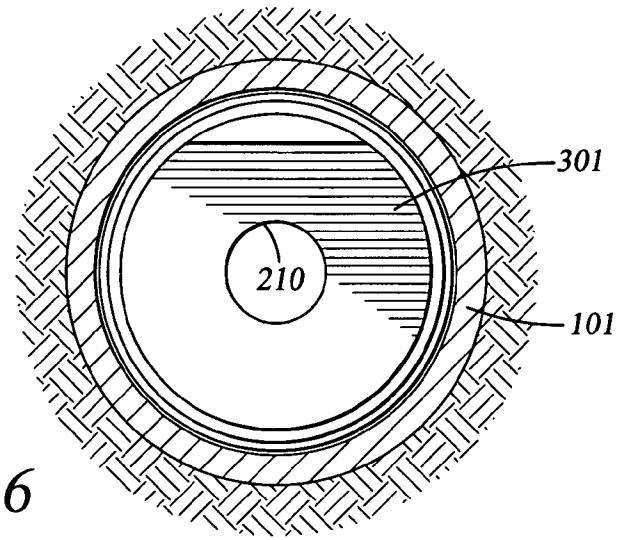
FIG. 6 is an end view of FIG. 5.
Figure 5:
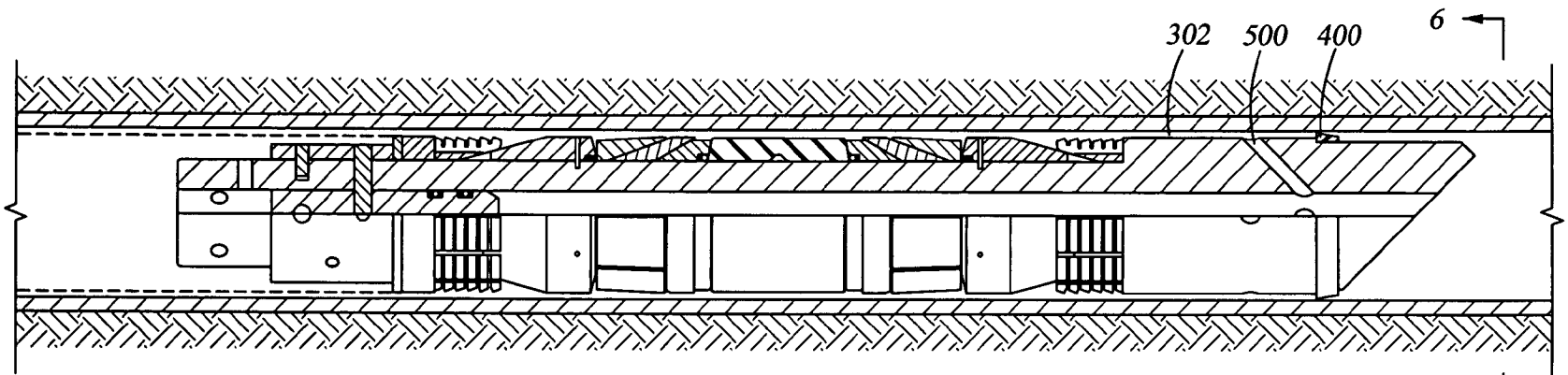
FIG. 5 is section view of another tool showing additional embodiments of the invention.

FIGS. 5 and 6 illustrate another embodiment of the invention that includes an additional feature also designed to facilitate the insertion of the tool into a wellbore. FIG. 5 shows another version of the tool 200 previously described with a wiper ring 400 installed around an outer perimeter of the tool 200 in a manner whereby the ring 400 extends into the annular space 302 between the tool 200 and the wellbore 100. The purpose of the wiper ring 400 is to increase back pressure on and around the tool as fluid is pumped past it and used to urge the tool along the wellbore 100.

Also shown in FIG. 5 are flow ports 500 radially extending around the tool just behind the wiper ring 400 to direct a portion of the fluid from the annular space 302 to an area in front of the tool 200. The redirection of some of the fluid helps wash debris from the front of the tool while permitting adequate fluid flow to act on the wiper ring 400 as discussed above.

The wiper ring 400 increases that back pressure and its use with the centralizing rollers 300 is especially effective since the tool 200 is centered in a way that permits the wiper ring 400 to circumferentially extend into the annular space 302 around the tool rather than assuming an eccentric position due to the effect of gravity in a non-vertical wellbore.

Figure 7:
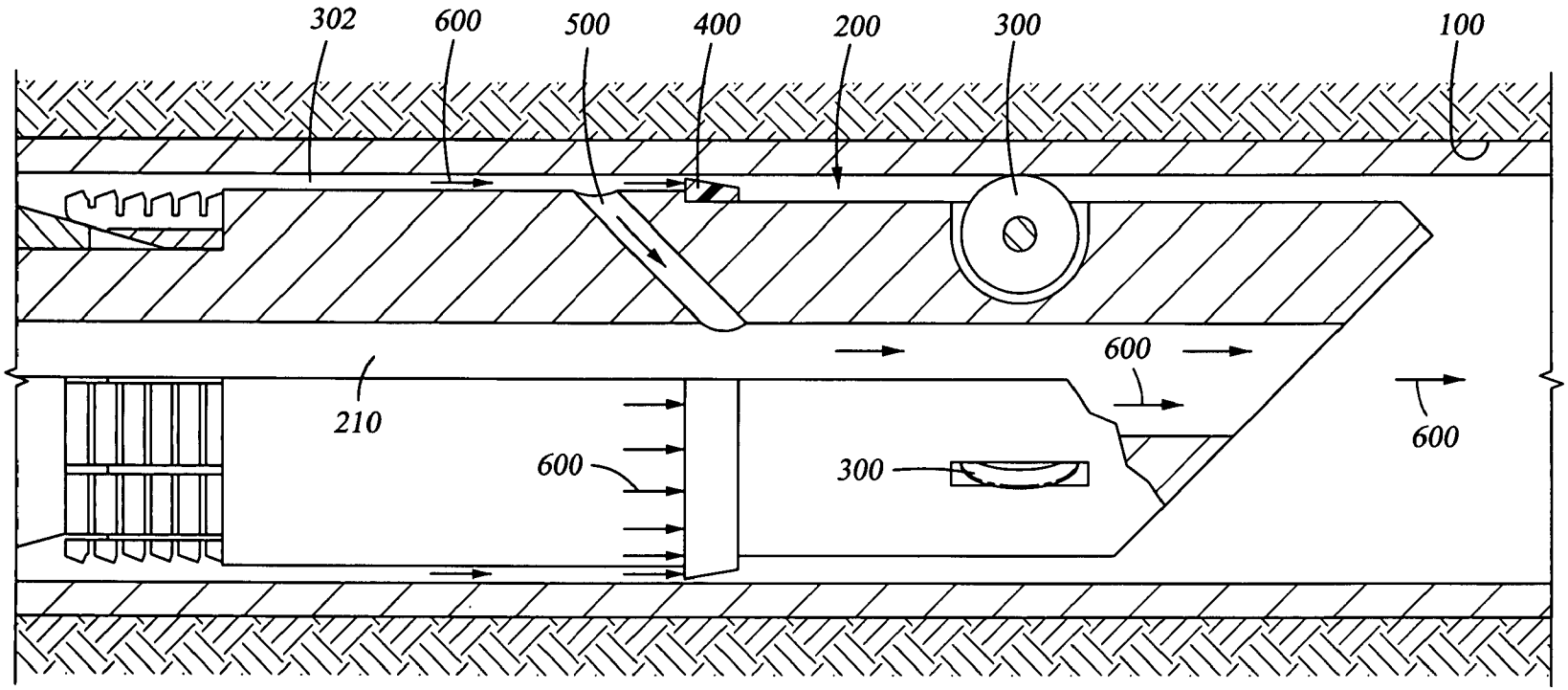
FIG. 7 is an enlarged section view illustrating the flow of the fluid through and around the tool of FIG. 5 as it is being pumped down a wellbore.

FIG. 7 uses arrows 600 to illustrate the flow of fluid through and around the tool 200 as it is urged along the wellbore 100. The arrows show for example, that a certain portion of the fluid flow is directed to the wiper ring 400 and another portion flows into the ports 500 and out the front tool which includes a "mule shoe" shape 208 at its front end to avoid obstructions in the wellbore. The combination of the various optional features of the invention act together to increase the effectiveness of fluid pushed past the tool in order to urge it along a wellbore, especially a non-vertical wellbore.

The system of the present invention is especially useful with tools made substantially of non-metallic material since these are typically lighter than metallic tools and have even less inclination to move in a non-vertical wellbore on their own. The parts of the system including the rollers, axles and the wiper ring are easily and typically made of non-metallic, drillable material and hence do not impede the milling and destruction of a non-metallic or composite bridge plug, like the one described in the '153 patent incorporated previously herein. Additionally, the components can be made of material effective in uses in extreme pH conditions.

As described and as shown in the FIGS., the present invention overcomes many problems associated with running tools into a non-vertical wellbore, especially on wireline or other non-rigid run-in strings.

While the foregoing is directed to embodiments of the present invention, other and further embodiments of the invention may be devised without departing from the basic scope thereof, and the scope thereof is determined by the claims that follow.

The invention claimed is:

1. A downhole tool for transportation into a wellbore, the tool comprising:

a body, the body having a sealable bore longitudinally formed therethrough;

a slip assembly for selectively fixing the tool in a wellbore; and a friction reducing system comprising at least two radially extending rollers for centering the tool in the wellbore as it is transported, wherein:

the tool is substantially formed of non-metallic material, and the body of the tool is substantially held off walls of the wellbore by the radially extended rollers.

2. The downhole tool of claim 1, wherein there are at least three rollers radially disposed around an outer circumference of the tool body.

3. The downhole tool of claim 2, wherein the rollers are located proximate a leading edge of the tool.

4. The downhole tool of claim 1, wherein the tool is insertable into a wellbore with wireline and a setting tool.

5. The downhole tool of claim 1, wherein the tool further comprises a wiper ring disposed around a circumference thereof, the wiper ring extending into an annular space formed between the tool and the wall of the wellbore.

6. The downhole tool of claim 5, wherein the tool further comprises flow ports formed in a wall of the tool and leading to the bore of the tool, the flow ports for directing fluid from the annular space to an area of the wellbore in front of the tool during transportation of the tool into the wellbore.

7. A method of installing a tool in a wellbore comprising:

lowering the tool on wireline, the tool capable of being fixed in the wellbore and including a centering system having at least two rollers for keeping the tool centered in the wellbore; and urging the tool into a non-vertical portion of the wellbore by pumping fluid past the tool in an annular area created by the centered tool and the wellbore.

8. The method of claim 7, wherein the tool further includes a wiper ring partially sealing the annular area, the wiper ring acting as a piston surface for fluid pumped past the tool.

9. The method of claim 8, wherein the tool further includes flow ports extending through a wall of the tool between the annulus and a front end of the tool.

10. A method of installing a tool in a wellbore, comprising:

running a tool string into a non-vertical section of the wellbore using a run-in string, the tool string comprising:

a setting tool coupled to the run-in string, and a tool coupled to the setting tool, the tool comprising:

a body, the body having a sealable bore longitudinally formed therethrough, a slip assembly disposed along an outer surface of the body, and a friction reducing system comprising at least two radially extending members disposed on the body, wherein the two members engage the wellbore and center the tool in the wellbore during running; and actuating the setting tool, wherein the setting tool exerts a force on the tool, thereby setting the slip assembly into engagement with the wellbore.

11. The method of claim 10, wherein:

the tool is a plug, the tool further comprises a sealing member disposed along an outer surface of the body, and the force exerted by the setting tool also expands the sealing member into engagement with the wellbore.

12. The method of claim 10, wherein the members are rollers.

13. The method of claim 12, wherein the rollers are located proximate a leading edge of the tool.

14. The method of claim 10, wherein running the tool string comprises pumping fluid into the wellbore behind the tool.

15. The method of claim 14, wherein the tool further comprises a wiper ring disposed around the body, the wiper ring acting as a piston surface for the fluid.

16. The method of claim 15, wherein the tool further comprises flow ports formed in the body and leading to the bore of the body, the flow ports allowing a portion of the fluid to bypass the wiper ring and exit a front of the body.

17. The method of claim 10, wherein the tool is substantially formed of non-metallic material.

18. The method of claim 17, further comprising milling or drilling through the tool.

19. The method of claim 11, wherein the plug is set at a depth below a hydrocarbon-bearing formation and the method further comprises treating the formation.

20. The method of claim 19, wherein treating comprises fracturing.

21. The method of claim 20, wherein the formation comprises multiple zones.

22. The method of claim 10, wherein the run-in string is wireline or coiled tubing.

23. The method of claim 10, wherein the run-in string is wireline.

24. The method of claim 12, wherein the rollers are spring-mounted on the body.

25. The method of claim 10, wherein a front end of the body is mule shoe shaped.

26. The method of claim 10, wherein the wellbore is cased.

27. A down hole tool for transportation into a wellbore, the tool comprising:

a body, the body having a sealable bore longitudinally formed therethrough;

a slip assembly for selectively fixing the tool in a wellbore; and a friction reducing system comprising at least three radially extending rollers for centering the tool in the wellbore as it is transported, the rollers radially disposed around an outer circumference of the body, wherein the body is substantially held off walls of the wellbore by the radially extended rollers.

28. A downhole tool for transportation into a wellbore, the tool comprising:

a body, the body having a sealable bore longitudinally formed therethrough;

a slip assembly for selectively fixing the tool in a wellbore;

a friction reducing system comprising at least two radially extending members for centering the tool in the wellbore as it is transported;

a wiper ring disposed around a circumference thereof, the wiper ring extending into an annular space formed between the tool and the wall of the wellbore; and flow ports formed in a wall of the tool and leading to the bore of the tool, the flow ports for directing fluid from the annular space to an area of the wellbore in front of the tool during transportation of the tool into the wellbore.

29. The downhole tool of claim 28, wherein the tool is substantially formed of non-metallic material.

* * * * *